United States Patent [19]

Dahrendorf et al.

[11] Patent Number: 5,016,627

[45] Date of Patent: May 21, 1991

[54] LUNG-GOVERNED VALVE

[75] Inventors: Klaus D. Dahrendorf; Peter Kling; Ulrich Kriems, all of Berlin, Fed. Rep. of Germany

[73] Assignee: Auergesellschaft GmbH, Fed. Rep. of Germany

[21] Appl. No.: 441,829

[22] Filed: Nov. 27, 1989

[30] Foreign Application Priority Data

Nov. 28, 1988 [DE] Fed. Rep. of Germany ..... 3840058

[51] Int. Cl.[5] ..... A62B 18/02

[52] U.S. Cl. ..... 128/205.24; 128/207.12; 128/204.29

[58] Field of Search ..... 128/204.29, 205.24, 128/207.12, 207.16; 137/493, 493.7

[56] References Cited

U.S. PATENT DOCUMENTS 4,699,137 4/1986 Schroeder ..... 128/205.24

4,858,606 8/1989 Hamlin ..... 128/204.29

*Primary Examiner*—Edgar S. Burr

*Assistant Examiner*—Eric P. Raciti

*Attorney, Agent, or Firm*—Reed Smith Shaw & McClay

[57] ABSTRACT

A lung-governed breathing valve used in a breathing mask for excess pressure operation. The valve has a casing with a spring-loaded control diaphragm which divides the casing into an outer chamber connected to the outside environment and a breathing chamber for conveying the gas for breathing. The control diaphragm controls a breathing gas inlet valve via a lever system and a manually released actuating button. The control diaphragm has a resilient raised portion formed integrally thereon with a recess therein. A push-rod integrally molded on the actuating button is positively engageable in the recess of the raised portion to prevent the lung-governed valve from being accidentally released or switched from the stand-by to the operative position.

9 Claims, 2 Drawing Sheets

LUNG-GOVERNED VALVE

FIELD OF THE INVENTION

The present invention relates to a breathing valve and more specifically to a lung-governed breathing valve for excess pressure operation in the interior of a breathing mask.

BACKGROUND OF THE INVENTION

A breathing mask is a device used to enable breathing in environments where such would be difficult or impossible without mechanical aid. Typically, a breathing mask incorporates an inlet valve which controls the flow of gas for breathing between a supply of breathing gas and the user of the breathing mask. A lung-governed valve controls the flow of gas through the inlet valve via the respiration of the user.

A diaphragm divides the lung-governed valve into an inner chamber at a pressure corresponding to the pressure within the breathing mask and an outer chamber at a pressure corresponding to the pressure in the environment. The diaphragm is coupled to a mechanism which opens and closes the inlet valve. The user's respiration creates a pressure differential between the inner and outer chambers of the valve which, in turn, causes displacement of the diaphragm thereby controlling the inlet valve closure mechanism.

A lung-governed valve of this type is described in German Patent No. DE 35 39 669 A1. In that device, the diaphragm controlling the inlet valve lever has at its central point a cam projecting outwardly into the outer chamber. A tilt lever is pivoted to the outer chamber casing and is clamped by transversely tensioned spring elements to the outer chamber so that the tilt lever is movable in a tilting joint. The tilt lever is movable out of an idle position into a first pressure position, exerting force on the diaphragm, and into a second stand-by position, lifting the diaphragm off the valve lever by engaging the cam and moving it and the diaphragm through a predetermined stroke. Because of the transversely tensioned spring elements, which are pivoted to the shorter end of the tilt lever, the end position of the tilt lever may be unstable. Subjection of the valve to external stress may cause the tilt lever to tilt from one position to the other. This instability is particularly disadvantageous when the control diaphragm is in the stand-by position. In this position, external vibration could tilt the lever, entraining the control diaphragm and opening the inlet valve via the valve lever. The limited amount of breathing gas available to the person using the apparatus can thus be inadvertently lost.

It would be desirable, therefore, to develop a lung-governed valve with an improved structural design wherein the valve is protected from accidental release or switching on when in the stand-by position.

SUMMARY OF THE INVENTION

Generally, the present invention relates to a lung-governed valve comprising a casing with a nozzle for supplying breathing gas, a nozzle for discharging breathing gas to a breathing mask, a pressurized control diaphragm and a releasable actuating button. The control diaphragm divides the lung-governed valve into an outer chamber at environmental pressure and an inner chamber at a pressure corresponding to the pressure within the mask. The control diaphragm controls a breathing-gas inlet valve through a lever system and the releasable actuating button.

The present invention is particularly advantageous in several respects First, the lung-governed valve can be firmly held in the stand-by position by a simple mechanical means and remains in that position when subjected to external vibration. Inadvertent loss of the limited supply of breathing gas is thereby prevented. Another advantage of the present invention is the controllability, independent of the direction of switching, of the control diaphragm when it is in the operative position. Additionally, manual control, by depressing the actuating button and maintaining it in the on position, enables a continuous supply of breathing gas to be provided for a second person, for cleaning of the mask from dangerous pollutants, and for relief of pressure from the supply nozzle after use. Finally, the user of the breathing mask is made aware that the lung-governed valve is in the operative mode by the visibility of the actuating button when the lung-governed valve is in that mode.

To achieve these advantages, the central region of the control diaphragm has a resilient raised portion formed integrally thereon with a recess therein. When the actuating button is released, a push-rod integrally molded on the actuating button is positively engageable in the recess of the raised portion of the control diaphragm. Furthermore, the raised portion of the control diaphragm closely abuts and is contained within a recess in an insertion member disposed above the control diaphragm.

Other details, objects and advantages of the present invention will become more readily apparent from the following description of a presently preferred embodiment thereof.

BRIEF DESCRIPTION OF THE DRAWINGS

In the accompanying drawings, a preferred embodiment of the present invention is illustrated, by way of example only, wherein.

DESCRIPTION OF THE PREFERRED EMBODIMENT

Figure 1:
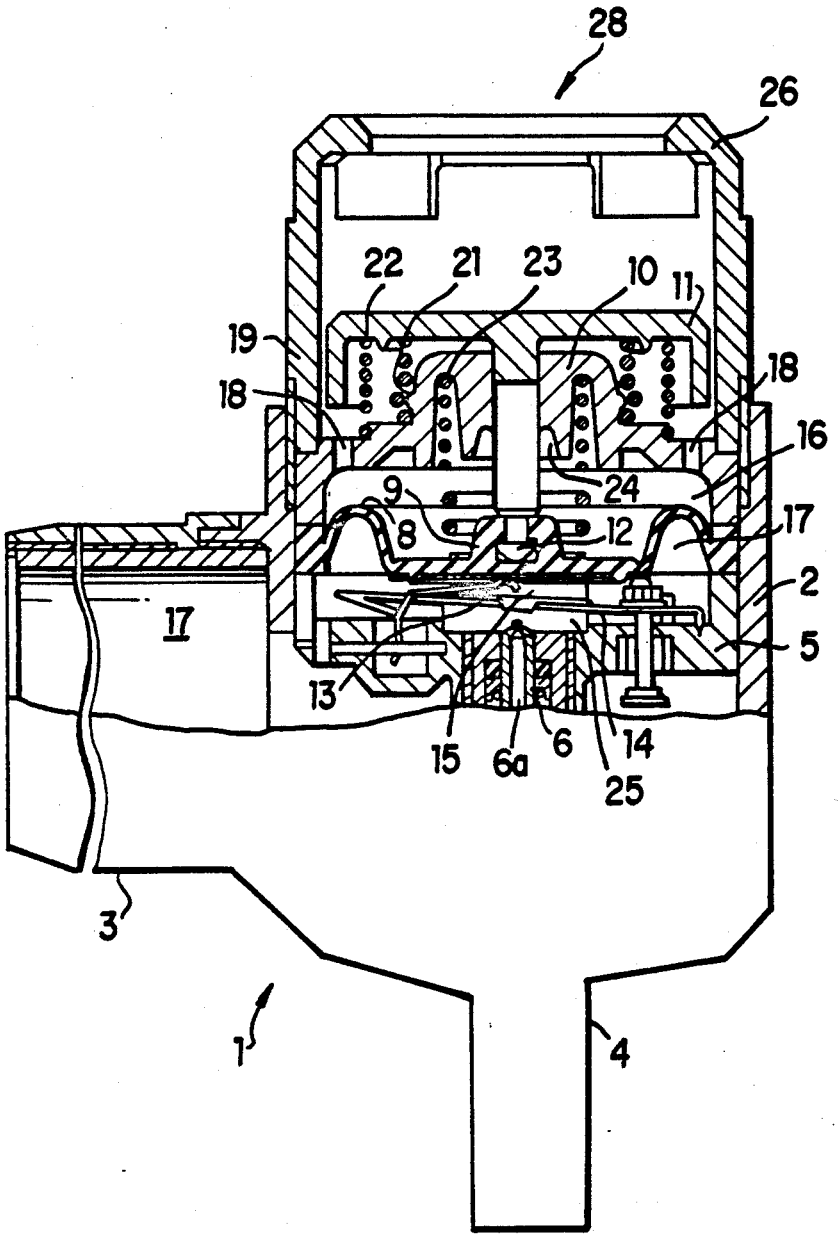
FIG. 1 is a partial section of the lung-governed valve of the present invention with the actuating button completely depressed.

As shown in FIG. 1, the present invention provides a lung-governed valve 1 comprising a casing 2 with a nozzle 4 for supplying gas for breathing, a nozzle 3 for discharging gas to a breathing mask (not shown), a pressurized control diaphragm 8 and a releasable actuating button 11. The supply nozzle 4 preferably contains a spring-loaded control piston 6 formed with a through bore *6a* disposed to be axially movable in an inlet valve member 5 and in operative connection with valve seat 7.

The control diaphragm 8 divides lung-governed valve 1 into an outer chamber 16 at environmental pressure, typically atmospheric pressure, and an inner breathing chamber 17 at a pressure corresponding to the pressure within the breathing mask. The outer chamber 16 is preferably connected to the atmosphere through a number of openings 18 in a pot-like insert 10. The periphery of control diaphragm 8 is preferably clamped on all sides between the inlet valve body 5 and the pot-like insert 10 in the valve casing 2.

Figure 2:
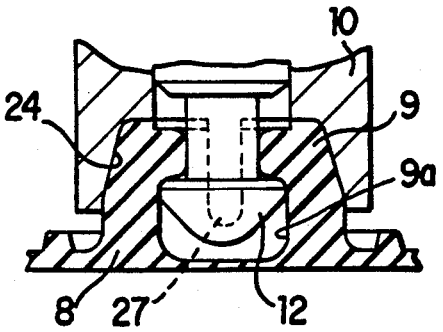
FIG. 2 is a close-up view of the raised portion of the control diaphragm which is engaged by the push-rod.

The control diaphragm 8 is formed with a means for engaging the actuating button 11 when the actuating button 11 is depressed. Preferably the center region of the control diaphragm has a resilient raised portion g integrally formed thereon (hereinafter referred to as nipple member 9) with a recess 9*a* formed therein such that an extension of the actuating button 11 is positively lockable in the recess 9*a*. In the preferred embodiment, the extension of the actuating button 11 is in the shape of a push-rod 12 which positively enters and entrains the nipple member 9 as shown in FIG. 2.

As FIG. 1 shows, when button 11 is completely depressed, the push-rod 12 engages positively in the resilient nipple member 9 of the control diaphragm 8. The inlet valve body 5 preferably contains two spacers 25 against which the nipple member 9 of the control diaphragm 8 firmly rests when the button 11 is depressed into the engagement position. These spacers 25 secure the control diaphragm 8, enabling the push-rod 12 to enter the nipple member 9. Because of the matching geometrical shape of the push-rod 12 and the protecting, screen-like nipple member 9, the control diaphragm 8 is firmly held and entrained by the actuating button 11.

Figure 5:
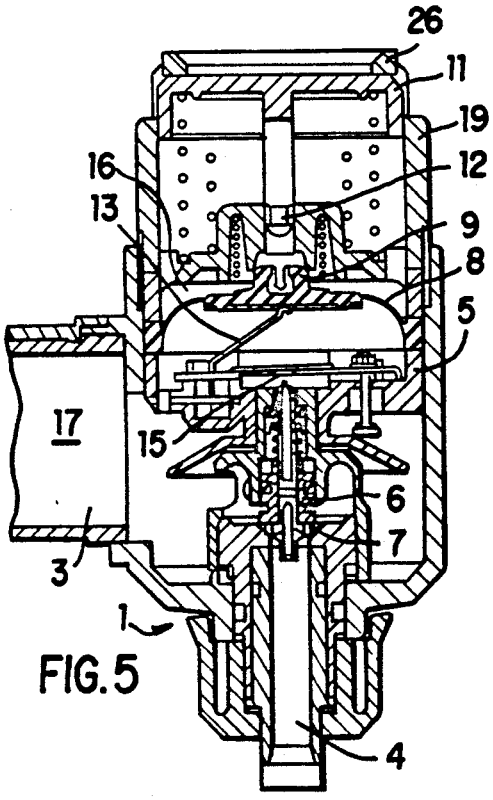
FIG. 5 shows the lung-governed valve of the present invention in the operative position.

In the operative position, the push-rod 12 and the nipple member 9 are separated, such as shown in FIG. 5, when the person wearing the breathing mask and the lung-governed valve 1 draws his first breath. Preferably, the nipple member 9 has two opposite slots 27 (see FIG. 2) which enable the push-rod 12 of the actuating button to unlock easily when the first breath is drawn, but not when the lung-governed valve is subjected to external vibrations in the stand-by position. As a result, switching to the operative position is experienced as pleasant by the person wearing the breathing mask.

Figure 4:
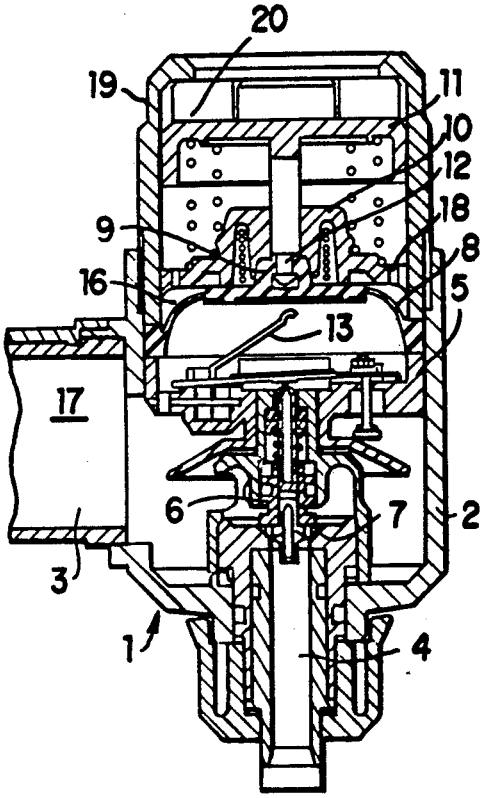
FIG. 4 shows the lung-governed valve of the present invention in the stand-by position.

In the preferred embodiment, the pot-like insert 10 is preferably constructed as a guide part for the axially movable actuating button 11, as a bearing part for receiving a means for returning the actuating button 11, and a means for maintaining excess pressure on the control diaphragm 8. Additionally, the pot-like insert 10 preferably has a recess 24 into which the nipple member 9 enters and is abuttingly contained therein when the lung-governed valve 1 is in the stand-by position. The stand-by position is shown in FIG. 4.

Preferably, excess pressure is maintained on the control diaphragm 8 by an adjustable excess-pressure spring 23 disposed centrally on the control diaphragm 8. The excess-pressure spring 23 by pressing with the appropriate force, determines the amount of excess pressure in the breathing chamber 17 and consequently the desired excess pressure inside the breathing mask.

The inlet valve body 5 has a means for opening and closing the through bore 6*a* in the control piston 6 by actuation of the control diaphragm 8. In the preferred embodiment, a tilt lever 13 is connected to one side of the inlet valve body 5 and cooperates with a counterpoise 14 and a closure part 15 to control the opening and closing of the through bore 6*a*.

The valve casing 2 is preferably closed by a tubular member 19 which acts as a shock absorber. The top of the tubular member is preferably formed with a through opening 28 for the actuating button 11. Window-like openings 20 are preferably distributed around the periphery of tubular member 19, enabling optical visibility of the actuating button 11 when the lung-governed valve 1 is in the operative position.

The actuating button 11 is preferably returned by a return spring 22. The return spring 22, which is disposed in the pot-like insert 10, is connected to the actuating button 11. When the lung-governed valve enters the operative position, the actuating button 11 moves outwards via expansion of the return spring 22, coming to rest against the abutment 26. In this position, the actuating button 11 is visible through the window-like openings 20. The actuating button 11 is preferably of a contrasting color to facilitate visibility.

To activate lung-governed valve 1 and place it in the on position, the tension-loaded actuating button 11 is depressed completely, causing the control diaphragm 8 to come to rest on the two spacers 25 and allowing the push-rod 12 to engage the nipple member 9. In this process, the tilt lever 13 revolves around its center of rotation and the closure part 15 of the counterpoise 14 lifts off the through bore 6*a* in the control piston 6 so that breathing gas can flow through. The breathing gas will continue to flow only so long as the actuating button 11 remains depressed. In this manner, the delivery of gas can be advantageously controlled by hand, allowing use by a second person, cleaning of the mask from pollutants, and relief of pressure from the supply nozzle after use.

FIG. 4 shows the inoperative position or the "stand-by" position of lung-governed valve 1. The stand-by position is automatically brought about by the expansion of the abutment spring 21 and the return spring 22 when the actuating button 11 is released from its fully depressed position. The abutment spring 21 is fairly strong while the return spring 22 is relatively weak. This is because the return spring 22 only needs to return actuating button 11 once the push-rod 12 has been disengaged from the nipple member 9 whereas abutment spring 21 pushes against actuating button 11 and the pot-like insert 10 such that the nipple member 9 of the control diaphragm 8 fits securely into and abuts the annular recess 24 in the pot-like insert 10. It also provides a strong force to release push-rod 12 when there is a negative pressure caused by the first inhaled breath. In this position, the push-rod 12 of the actuating button 11 cannot escape upwards any farther. If the lung-governed valve 1 is subjected to impact, the compressive effect intensifies, preventing the push-rod 12 from disengaging from the nipple member 9 and thereby switching the lung-governed valve 1 to the operative position.

When a breathing mask is connected to the delivery nozzle 3, the first inhalation of the user creates an excess negative pressure inside the mask and consequently an excess negative pressure in the breathing chamber 17. This excess negative pressure, which is produced only during the first breath, causes the control diaphragm 8 and the engaged push-rod 12 to be pulled downwards from the position shown in FIG. 4. The actuating button 11 and the push-rod 12 press against the abutment spring 21 and the return spring 22 until the resulting excess negative pressure combined with the force of the excess-pressure spring 23 release the nipple member 9 from the annular recess 24 and the push-rod 12 disengages the nipple member 9. The lung-governed valve 1 is now in the operative position as shown in FIG. 5. The return spring 22 pushes the actuating button 11 as far as the upper abutment 26 of the tubular member 19. In this position, the actuating button 11 becomes visible through the window-like openings 20, showing the user or a third person that the valve is in the excess-pressure or operative position. In the operative position, the control diaphragm 8, can move freely during subsequent breathing. The control diaphragm 8 controls the opening of the inlet valve by rotating the tilt lever 13 and consequently raising the control piston 6 from the valve seat 7.

Figure 3:
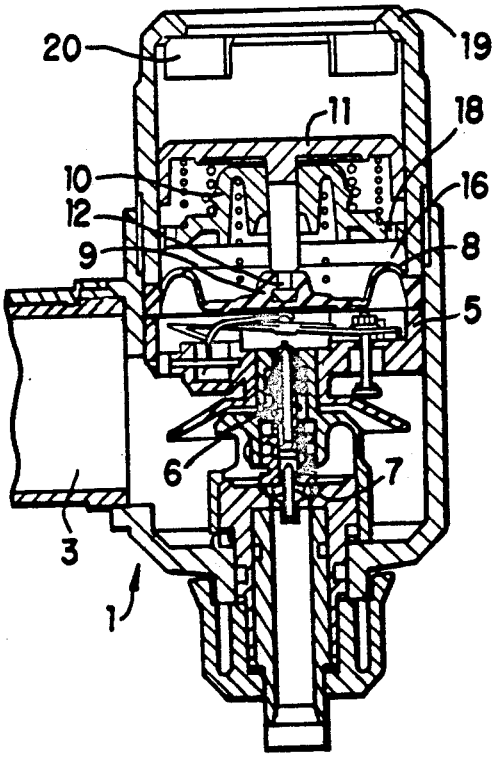
FIG. 3 shows the lung-governed valve of the present invention in the on position.

To switch off the lung-governed valve 1, the actuating button 11 must be fully depressed as shown in FIG. 3, enabling the push-rod 12 to engage the nipple member 9 and move to the stand-by position shown in FIG. 4.

While a presently preferred embodiment of practicing the invention has been shown and described with particularity in connection with the accompanying drawings, the invention may be otherwise embodied within the scope of the following claims.

What is claimed is:

1. A lung-governed valve for use with a breathing mask comprising: a valve casing having a first nozzle for providing breathing gas and a second nozzle for discharging breathing gas to the breathing mask; a control diaphragm which divides the lung-governed valve into an outer chamber connected to environmental pressure and a breathing chamber for conveying the breathing gas to the breathing mask; a spring mechanism for biasing the control diaphragm; a lever system connected between the underside of the control diaphragm and a breathing-gas inlet valve; the breathing-gas inlet valve connected to the first nozzle, and a manually accessible actuating button; wherein a central region of the control diaphragm is formed with a resilient raised portion thereon which as a recess therein such that when the actuating button is released after being depressed, a push-rod integrally formed on the actuating button is positively lockable in the recess such that the control diaphragm is entrained by the actuating button through the push-rod and is guided into a stand-by position wherein the resilient raised portion closely abuts and is contained within a recess in a pot-like insertion member permanently disposed above the control diaphragm in the casing; and wherein the control diaphragm can be in an operative position such that the push-rod is disengaged from the recess.

2. A lung-governed valve as described in claim 1 wherein the spring mechanism comprises an abutment spring, a return spring and an excess pressure spring which bear against the insertion member; and the insertion member is constructed as a guide part for the actuating button which is axially movable therethrough.

3. A lung-governed valve as described in claim 1 wherein the resilient raised portion of the control diaphragm has two opposite slots.

4. A lung-governed valve as described in claim 1 wherein the periphery of the control diaphragm is clamped on all sides in the valve casing between an inlet valve body and the pot-like insertion member.

5. A lung-governed valve as described in claim 4 wherein a spring-loaded control piston is disposed so as to be axially movable in the inlet valve body which has a through bore for the breathing gas such that the control piston is in operative connection with an inlet valve seat to control the breathing gas.

6. A lung-governed valve as described in claim 5 wherein the lever system includes a tilt lever disposed on a side of the inlet valve body facing the control diaphragm and is in operative connection with a counterpoise clamped at one side to the inlet valve body.

7. A lung-governed valve as described in claim 6 wherein a closure member is disposed on the counterpoise and opens and/or closes the through bore in the inlet valve body via the tilt lever and by means of the control diaphragm to be actuated.

8. A lung-governed valve as described in claim 7 wherein the return spring is connected to the actuating button and when the lung-governed valve is in the operative position moves the actuating button into an optically visible end position.

9. A lung-governed valve as described in claim 8 wherein a tubular member is inserted in to the valve casing and is formed at its top end with an opening for the actuating button and window-like openings through which the actuating button, which is in contrasting colors, is optically visible when the lung-governed valve is switched to the operative position.

* * * * *